US006913081B2

(12) United States Patent
Powell et al.

(10) Patent No.: US 6,913,081 B2
(45) Date of Patent: Jul. 5, 2005

(54) COMBINED SCALE INHIBITOR AND WATER CONTROL TREATMENTS

(75) Inventors: Peter Powell, Liverpool (GB); Michael A. Singleton, Edinburgh (GB); Kenneth S. Sorbie, Edinburgh (GB)

(73) Assignee: Baker Hughes Incorporated, Houston, TX (US)

( * ) Notice: Subject to any disclaimer, the term of this patent is extended or adjusted under 35 U.S.C. 154(b) by 183 days.

(21) Appl. No.: 10/359,904

(22) Filed: Feb. 6, 2003

(65) Prior Publication Data

US 2004/0154799 A1 Aug. 12, 2004

(51) Int. Cl.[7] ..... E21B 37/06

(52) U.S. Cl. ..... 166/279; 166/300; 166/304; 166/312

(58) Field of Search ..... 166/279, 300, 166/304, 305.1, 310–312

(56) References Cited

U.S. PATENT DOCUMENTS

| | | | | |
|---|---|---|---|---|
| 3,308,885 A | | 3/1967 | Sandiford | |
| 4,095,651 A | | 6/1978 | Chauveteau et al. | |
| 4,191,249 A | * | 3/1980 | Sarem | 166/305.1 |
| 4,602,683 A | | 7/1986 | Meyers | |
| 4,708,974 A | | 11/1987 | Chang et al. | |
| 4,718,491 A | | 1/1988 | Kholer et al. | |
| 4,842,071 A | | 6/1989 | Zaitoun et al. | |
| 4,860,829 A | | 8/1989 | Carlberg et al. | |
| 5,082,577 A | | 1/1992 | Kohler et al. | |
| 5,181,567 A | * | 1/1993 | Shuler | 166/279 |
| 5,219,476 A | | 6/1993 | Lockhart et al. | |
| 5,244,043 A | | 9/1993 | Shuler | |
| 5,655,601 A | | 8/1997 | Oddo et al. | |
| 5,816,323 A | | 10/1998 | Sydansk | |
| 6,063,290 A | * | 5/2000 | Failon et al. | 210/699 |
| 6,148,913 A | | 11/2000 | Collins | |
| 6,173,780 B1 | | 1/2001 | Collins et al. | |
| 6,228,812 B1 | | 5/2001 | Dawson et al. | |

FOREIGN PATENT DOCUMENTS

| | | | |
|---|---|---|---|
| WO | WO 98/30783 | * | 7/1998 |
| WO | WO 01/59255 A1 | | 8/2001 |

OTHER PUBLICATIONS

G. E. Payne, "A History of Downhole Scale Inhibition by Squeeze Treatments on the Murchison Platform," Offshore Europe 87, Sep. 8–11, 1987, 12 pp., SPE 16539/1, Society of Petroleum Engineers.

M. R. Avery, et al., "Field Evaluation of a New Gelant for Water Control in Production Wells," 63rd Annual Technical Conference and Exhibition of the Society of Petroleum Engineers, Oct. 2–6, 1988, pp. 203–214, SPE 18201, Society of Petroleum Engineers.

K. S. Sorbie, et al., "Application of Scale Inhibitor Squeeze Model to Improve Field Squeeze Treatment Design," European Petroleum Conference, Oct. 25–27, 1994, pp. 179–191, SPE 28885, Society of Petroleum Engineers.

R. D. Hutchins, et al., "Field Applications of High Temperature Organic Gels for Water Control," 1996 SPE/DOE Tenth Symposium on Improved Oil Recovery, Apr. 21–24, 1996, pp. 419–426, SPE/DOE 35444, Society of Petroleum Engineers.

(Continued)

*Primary Examiner*—Zakiya Walker
(74) *Attorney, Agent, or Firm*—Madan, Mossman & Sriram P.C.

(57) ABSTRACT

A combined scale inhibitor treatment and water control treatment requires fewer steps than the sum of each treatment procedure practiced separately. The control of water production simultaneously further reduces the amount of scale formed. Conventional water control chemicals and scale inhibitors of a wide variety of types can still be employed to advantage, and the same equipment may be used as employed for the treatments implemented separately.

19 Claims, 5 Drawing Sheets

OTHER PUBLICATIONS

P. D. Ravenscroft, et al., "Magnus Scale Inhibitor Squeeze Treatments—A Case History," 1996 SPE Annual Technical Conference and Exhibition, Oct. 6–9, 1996, pp. 403–408, SPE 36612, Society of Petroleum Engineers.

M. M. Jordan, et al., "The Design of Polymer and Phosphonate Scale Inhibitor Precipitation Treatments and the Importance of Precipitate Solubility in Extending Squeeze Lifetime," 1997 SPE International Symposium on Oilfield Chemistry, Feb. 18–21, 1997, pp. 641–651, SPE 37275.

E. Samari, et al., "Water Shutoff Treatments in Eastern Alberta: Doubling Oil Production, Decreasing Water Cut by 20%," SPE/DOE Eleventh Annual Symposium on Improved Oil Recovery, Apr. 19–22, 1998, pp. 153–159, SPE 39617, Society of Petroleum Engineers.

M. J. Faber, et al., "Water Shut–Off Field Experience With a Relative Permeability Modification System in the Marmul Field (Oman)," 1998 SPE/DOE Improved Oil Recovery Symposium , Apr. 19–22, 1998, pp. 1–16, SPE 39633, Society of Petroleum Engineers.

N. Poynton, et al., "Squeezing Aqueous Based Scale Inhibitors Into a Water Sensitive Reservoir—Development of a Squeeze Strategy," 2000 Second International Symposium on Oilfield Scale, Jan. 26–27, 2000, pp. 1–14, SPE 60219, Society of Petroleum Engineers.

R. D. Sydansk, et al., "More Than 12 Years' Experience With a Successful Conformance–Control Polymer–Gel Technology," SPE Prod. & Facilities, Nov. 2000, pp. 270–278, vol. 15, No. 4.

R. Castano, et al., "Relative Permeability Modifier and Scale Inhibitor Combination in Fracturing Process at San Francisco Field in Colombia, South America," SPE Annual Technical Conference and Exhibition, Sep. 29–Oct. 2, 2002, pp. 1–10, SPE 77412, Society of Petroleum Engineers.

* cited by examiner

COMBINED SCALE INHIBITOR AND WATER CONTROL TREATMENTS

FIELD OF THE INVENTION

The invention relates to treatments of subterranean formations to control water production and inhibit scale formation, and most particularly relates, in one non-limiting embodiment, to methods and compositions for controlling water production and inhibiting scale occurrence together in subterranean formations with a minimum number of steps.

BACKGROUND OF THE INVENTION

Water production is one of the major problems that occur in oil producer wells, which are at their most profitable when they are producing only oil. Produced water is an inevitable consequence of water injection when waterflooding is used to develop an oil reservoir or when the field drive mechanism involves strong aquifer support. Various problems are associated with the production of water including (a) the "lifting" (pumping) of the water itself from downhole to the surface, (b) the corrosion that may occur in downhole completions, tubulars, valves and surface equipment due to the corrosivity of the produced brine, (c) in some cases, mineral scale deposition due to the presence of precipitating minerals in the produced water (commonly calcite—calcium carbonate and barite—barium sulphate etc.), (d) the possible formation of gas hydrates (water/gas "ice") at low temperatures in sub-sea lines, and (e) the treating of the water to remove any environmentally unfriendly substances (such as low levels of hydrocarbons) before disposal, etc. All of these problems result in expenditure of time, money and other resources and hence, are detrimental to the profitability of an oil production operation.

A chemical treatment that would reduce water production while preserving the flow of oil in an oil production well is known as a "water control" treatment (WCT). Many patents exist based on polymeric materials and their cross-linked gels, and also on other materials, describing how to perform such treatments. Likewise, certain downhole chemical treatments to inhibit the formation of mineral scale using chemical scale inhibitors are also well known and are referred to as "scale inhibitor 'squeeze' treatments" (SISTs). Again, many scale inhibitor chemicals and application processes are described in the scientific and patent literature.

As will be discussed in further detail, water control treatments and scale inhibitor treatments of subterranean formations involve a number of steps to achieve effective results. As will also be further explained, scale formation is partly a function of water production. Thus, it would be desirable if methods or techniques could be found which would combine these treatments so that the total number of steps could be minimized, yet achieve comparable results.

SUMMARY OF THE INVENTION

An object of the invention is to provide methods and techniques for controlling water production and scale formation in a subterranean formation in the same operation.

Another object of the invention is to provide combined methods and techniques for controlling water production and scale formation in a subterranean formation that may employ conventional chemistries.

Yet another object of the invention is to provide combined methods and techniques for controlling water production and scale formation in a subterranean formation that may employ conventional equipment and steps combined in a novel way.

In carrying out these and other objects of the invention, there is provided, in one form, a method for inhibiting the formation of scale and the production of water in a well in a subterranean formation having a water production zone or zones, which involves first shutting in the well. A water control treatment is injected into the water production zone. A scale inhibitor is squeezed into the water production zone before, during or after the water control treatment. Next, the well is soaked in for a period of time. Finally, the well is back produced. In one non-limiting embodiment of the invention, the injection of the water control treatment is the next stage after squeezing the scale inhibitor into the water production zone, in the absence of an intervening step or stage.

DETAILED DESCRIPTION OF THE INVENTION

Figure 1A:
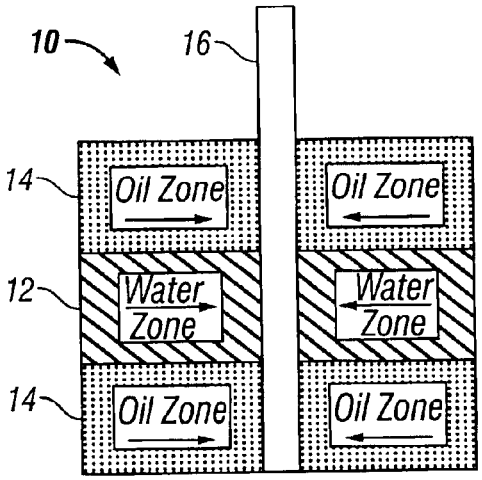
FIGS. 1(*a*) through 1(*d*) are schematic, cross-sectional illustrations of the types of water control problems arising in producer wells, FIGS. 1(*a*) and 1(*c*), and the two types of Water Control Treatment (WCT), a conventional zone blocking water shut-off treatment (WSOT), FIG. 1(*b*), and relative permeability modifier treatment (RPMT) FIG. 1(*d*)
Figure 1B:
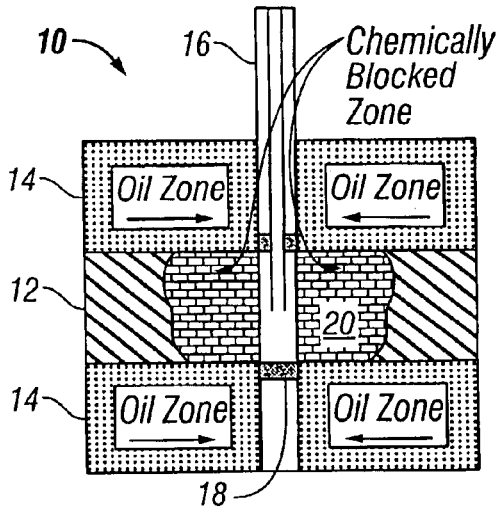
Figure 1C:
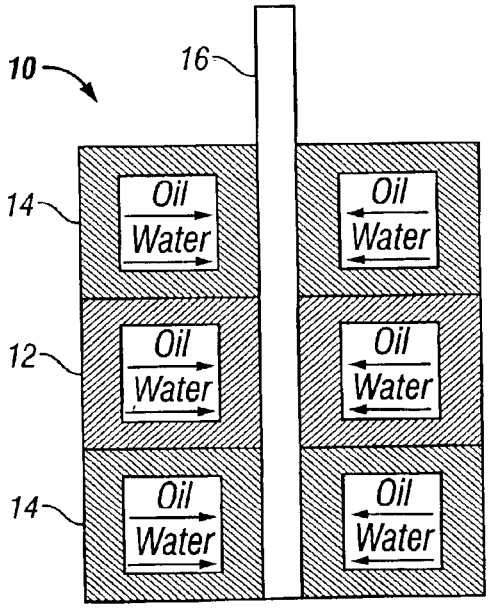
Figure 1D:
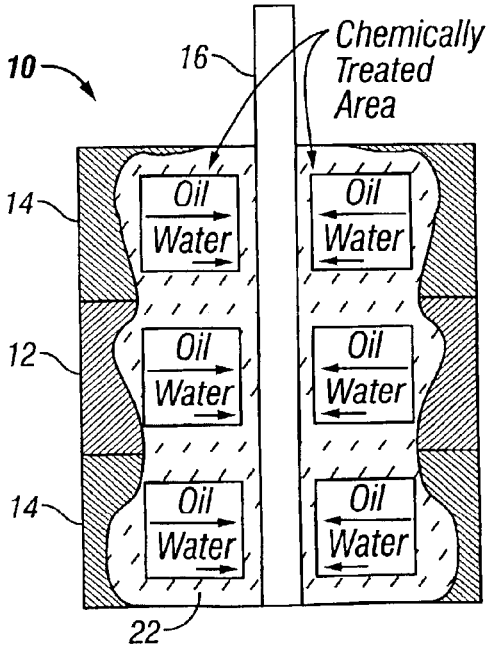
Figure 2A:
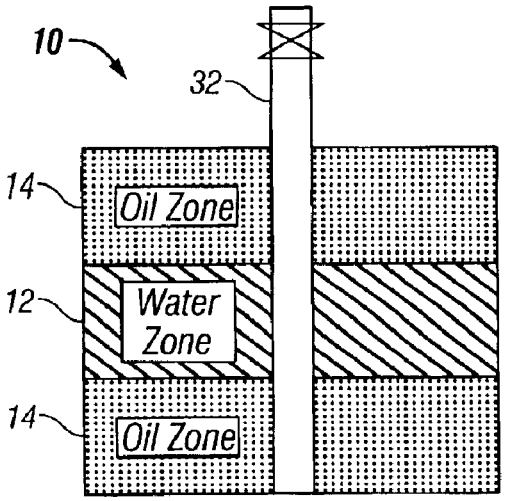
FIGS. 2(*a*) through 2(*f*) are schematic, cross-sectional illustrations of the major steps in a conventional scale inhibitor squeeze treatment (SIST)
Figure 2B:
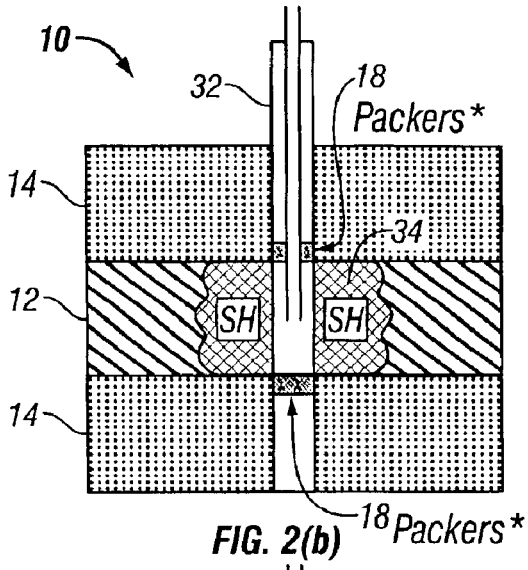
Figure 2C:
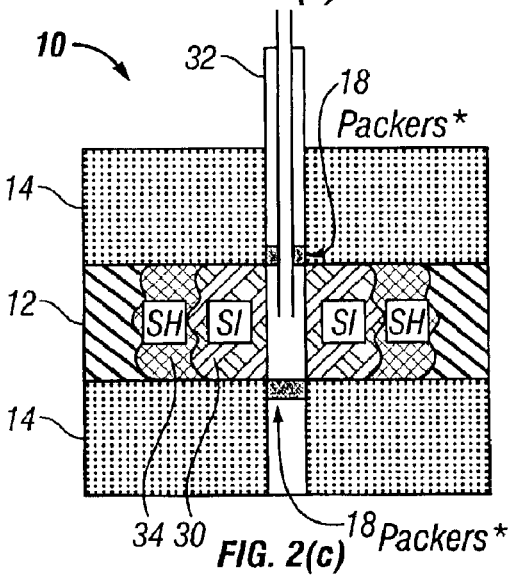
Figure 2D:
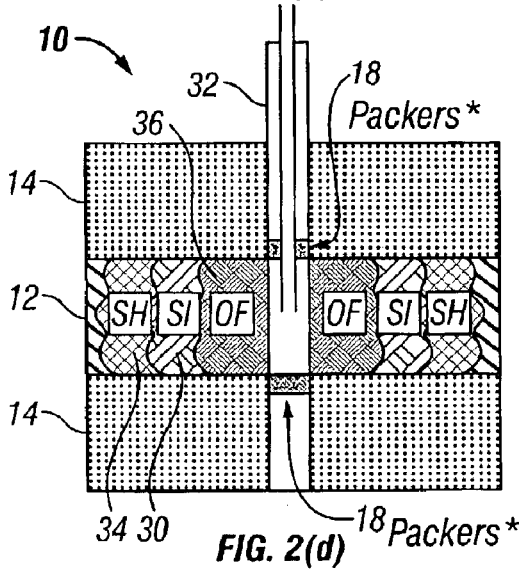
Figure 2E:
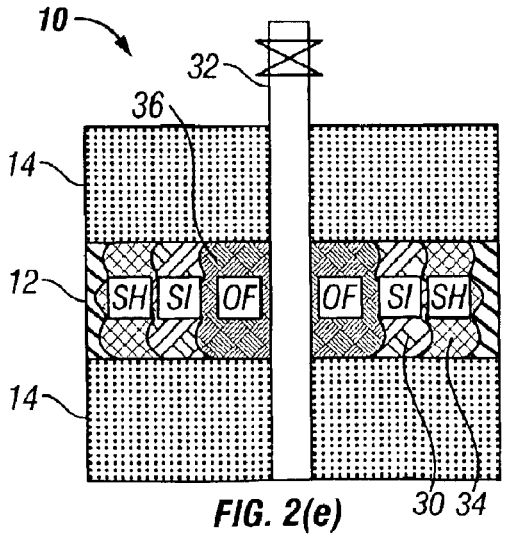
Figure 2F:
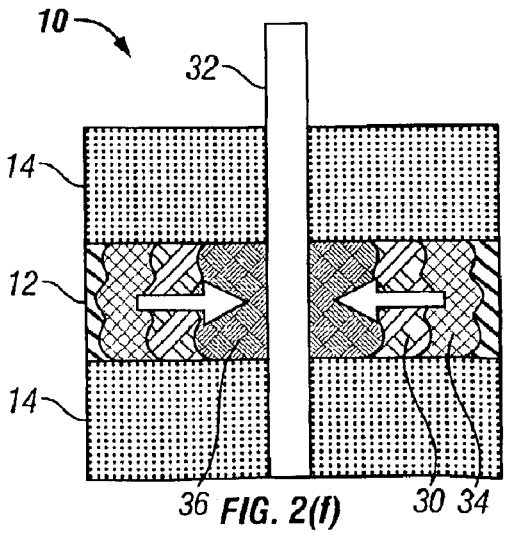
Figure 3A:
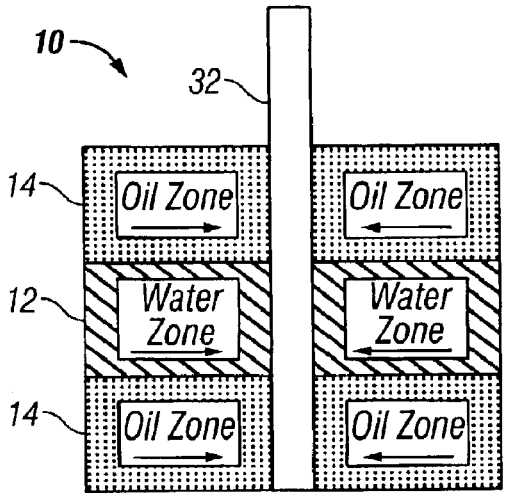
FIGS. 3(*a*) through 3(*e*) are schematic, cross-sectional illustrations of the major steps in one embodiment of the combined water control-scale inhibitor treatment of the present invention, where the water control features resemble a water shut-off treatment (WSOT)
Figure 3B:
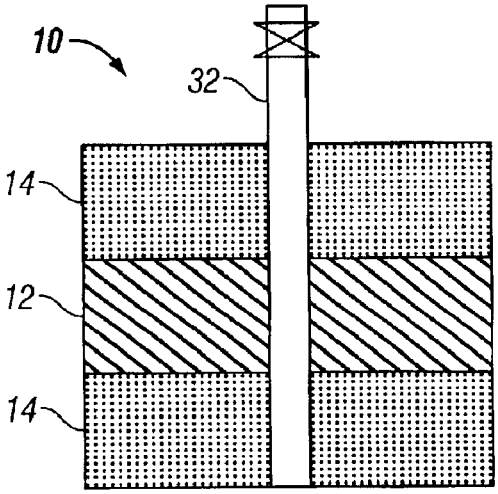
Figure 3C:
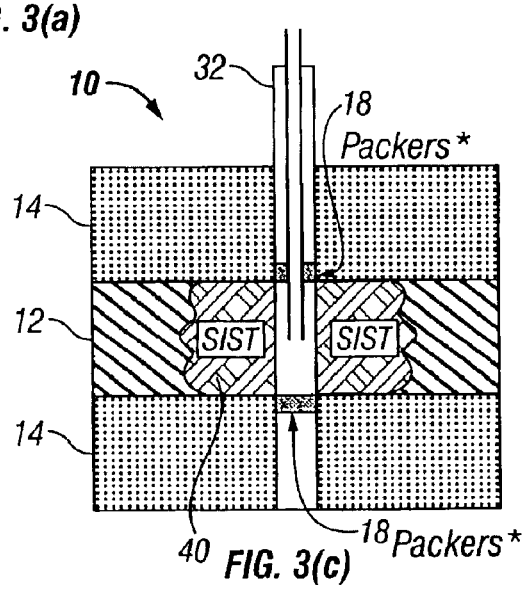
Figure 3D:
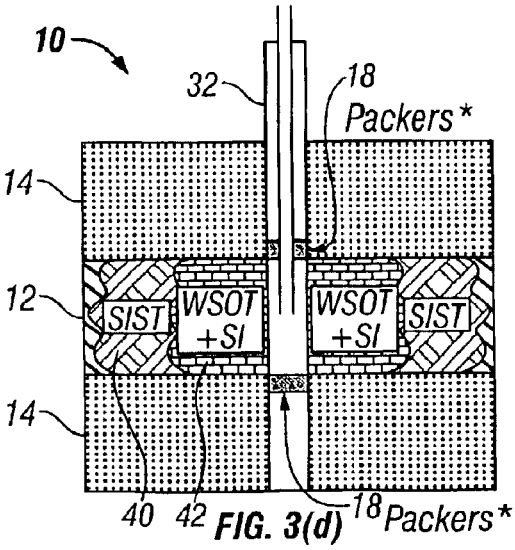
Figure 3E:
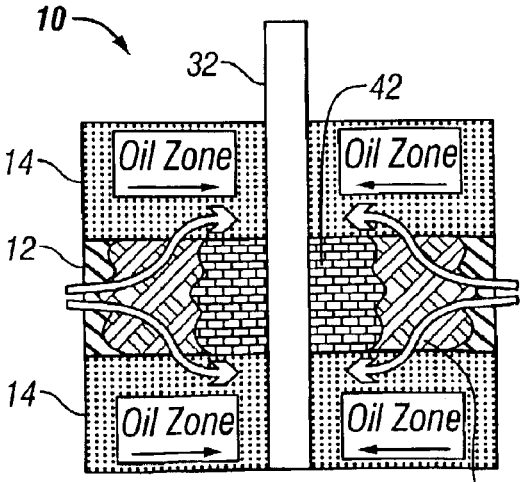
Figure 4A:
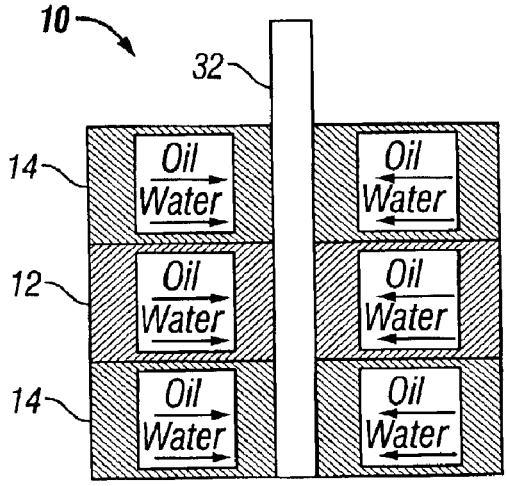
FIGS. 4(*a*) through 4(*e*) are schematic, cross-sectional illustrations of the major steps in one embodiment of the combined water control-scale inhibitor treatment of the present invention, where the water control features resemble a relative permeability modifier treatment (RPMT)
Figure 4B:
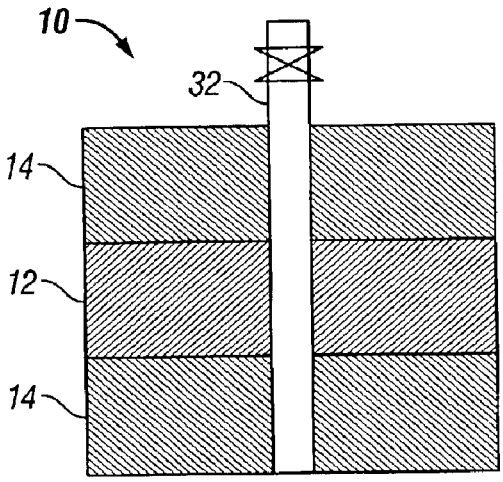
Figure 4C:
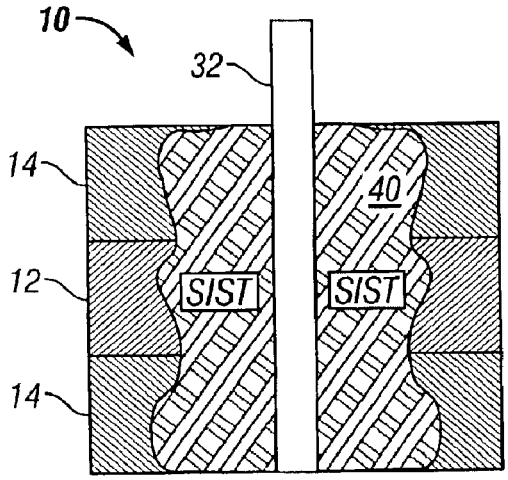
Figure 4D:
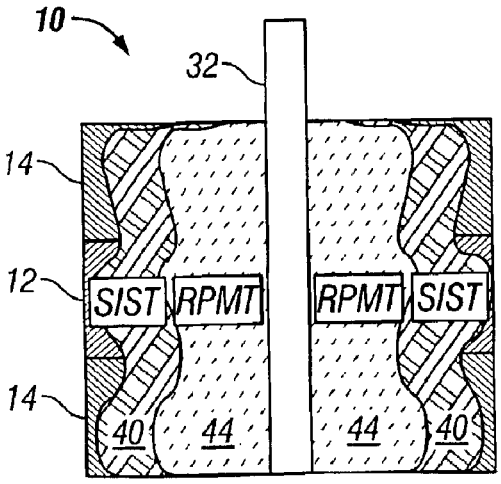
Figure 4E:
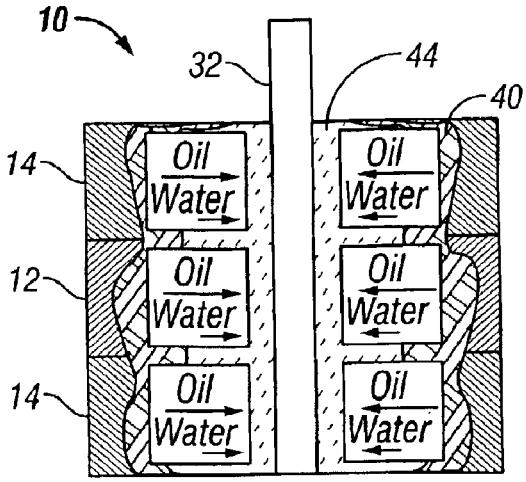

It has been discovered that water control treatments and scale inhibitor treatments can be combined to simultaneously control scale and inhibit water production in a subterranean formation using fewer total steps than the sum of steps used in those treatments conventionally practiced separately. These combined treatments provide savings of cost, time and resources in improving the production of hydrocarbons from a subterranean formation.

Water Control Treatments (WCT)

Chemical applications have been described whereby a material (usually, but not exclusively, a polymer or a cross-linked polymer) is injected into a reservoir formation 10, typically 5–15 ft (1.5–4.5 m) radial penetration, with the purpose of reducing water production (see FIG. 1). Such materials 20 may operate through the following mechanisms.

(i) The first mechanism involves blocking all of the flow in a completely water-producing zone or stratum 12 of the reservoir 10. Such a water shut-off material 20 would normally be a strong cross-linked polymer gel and these are often referred to as "blocking gels". Schematic illustrations of how such gels operate are shown in FIGS. 1(*a*) and 1(*b*), where the water producing zone 12 of subterranean formation 10 is isolated with packers 18 before the treatment is applied. Chemical packages of this type and their field application methodology are referred to as water shut-off treatments (WSOTs). Suitable water shut-off materials 20 include, but are not necessarily limited to, cross-linked polysaccharides, polyacrylamides—sometimes in their hydrolysed form (HPAM)—as well as non-ionic and cationic forms of polyacrylamide; silica gels, resins, cement and other materials. Crosslinkers used to gel the polymers include, but are not necessarily limited to, aluminum (III), chromium (III), boron, several other metal ions and also many organic materials such as glyoxal.

(ii) The second mechanism includes selectively reducing the flow of water while allowing the oil to flow freely—or with minimal reduction in its flow. A material 22 used in such an operation would normally be a polymer or a polymer with a low level of cross-linking and is often referred to as a "relative permeability modifier" or as a "disproportionate permeability reducer" 22; below, such applications are denoted as relative permeability modifier treatments (RPMTs). These types of treatment are generally applied to all areas of the near wellbore 16 without any isolation (i.e. they are "bullheaded"). A schematic of how RPMTs are applied is shown in FIGS. 1(*c*) and 1(*d*). Suitable relative permeability modifier materials 20 include, but are not necessarily limited to, cross-linked polysaccharides, polyacrylamides in their hydrolysed, non ionic or cationic forms (as described above for WSOTs), applied as either polymer only or "weak gel" treatments; or other materials. Within the context of this invention, by "polymer only" refers to a polymer without any crosslinker, i.e. a non-crosslinked polymer. Also within the context of this invention, the term "weak gel" is defined as a gel that is still flowable or which may be poured in bulk volumes, as contrasted with relatively stronger gels used in WSOTs that will completely block the subterranean rock to all flow, and/or which will not flow. Suitable crosslinkers include those described above for WSOTs, although it will be understood that the polymers used in RPMTs may not be as highly crosslinked as the polymers used for WSOTs.

As noted above, examples of both of the above types of water control treatment have been proposed and described in the general scientific and patent literature.

Scale Inhibitor Squeeze Treatments (SISTs)

Many problems arise because of the production of water as noted above. One specific and important one is the deposition of mineral scale, which does not occur invariably but depends on the ionic composition of the produced brine in a manner that is generally quite well understood in terms of the solution chemistry. The severity of this problem in terms of how much scale is deposited under given conditions (of temperature and pressure) is also relatively well understood and depends on the composition of the produced brine, as well as other fluids and materials the produced brine comes into contact with. The most common mineral scales that occur in oil production operations are calcite (calcium carbonate, $CaCO_3$) and barite (barium sulphate, $BaSO_4$). Calcite forms when formation brines, at high pressure, containing high levels of calcium ($Ca^{2+}$) and bicarbonate ($HCO_3^-$) ions, are brought to the surface and the pressure reduces (or the reservoir pressure is lowered by production). At the lower pressure, insoluble calcite precipitates and carbon dioxide ($CO_2$) is released into the gas phase. Barite, on the other hand, is formed when incompatible brines mix and this usually occurs when barium rich formation brine mixes with sulphate rich injected sea water, a process that can occur in the vicinity of or in the producer wellbore.

To prevent scale formation in water producing wells, scale inhibitor "squeeze" treatments (SISTs) are quite routinely applied in petroleum reservoirs using various chemical scale inhibitors. Suitable scale inhibitors include, but are not necessarily limited to, phosphonates, (e.g. diethylenetriamine penta(methylene) phosphonic acid, DETPMP), polyphosphino-carboxylic acids (PPCAs) and polymers such as poly acrylate (PAA) and poly vinyl sulphonate (PVS), sulphonated polyacrylates (VS-Co), phosphonomethylated polyamines (PMPA) and combinations thereof.

A "squeeze" treatment, which is shown schematically in FIG. 2, is one where the scale inhibitor solution (generally but not invariably in aqueous solution) 30 is injected down the producing well 32 into the reservoir formation 10 and allowed to interact with the rock matrix and then the well is put back on production. As the produced brine flows past the treated rock formation 10 some of the scale inhibitor 30 desorbs or dissolves (depending on the inhibitor-rock interaction mechanism—see below) into the produced brine. Hence, the produced brine contains a low level of scale inhibitor (from <1 ppm to tens or hundreds of ppm). This low—often substoichiometric—level of scale inhibitor 30 is often enough to prevent the scale deposition from occurring.

At the heart of the mechanism of how such "squeeze" treatments work is the type of inhibitor-rock interaction referred to above which can be described by (i) an adsorption mechanism (Ad), (ii) a precipitation reaction (Pt) or, in the general case, (iii) a combined adsorption-precipitation reaction (Ad-Pt). The field application of scale inhibitors operating through each type of mechanism ((i)–(iii)) is denoted as SIST-Ad, SIST-Pt and SIST-Ad-Pt, respectively. The subsequent release of the inhibitor in SIST-Ad, SIST-Pt and SIST-Ad-Pt treatments is hence by a desorption, a dissolution or a combined desorption/dissolution mechanism, respectively.

The scale inhibitor squeeze treatment (SIST) may involve several steps in its actual application although the actual steps, the details of pump rates, the fluid volumes, the inhibitor types and concentrations involved may vary to some degree from one application to another. In general, a typical SIST involves the following stages as shown in FIG. 2:

1. Shut-in the producing well 32 (FIG. 2(*a*));
2. Inject a pre-flush or "spearhead" fluid 34 that is usually an aqueous solution of surfactant (demulsifier) and a low concentration of scale inhibitor (tens to hundreds ppm) (FIG. 2(*b*)) into the water producing zone 12;
3. Inject the main scale inhibitor 30 slug—typically on the order of tens to hundreds bbl (about 1–150 $m^3$) of scale inhibitor—in solution (usually aqueous brine) at concentrations of thousands of ppm to a few % (e.g. 1–10% as supplied) (FIG. 2(*c*));
4. Injection of a brine "overflush" 36 in order to "push" the inhibitor 30 slug deeper into the formation 12 away from the immediate vicinity of the wellbore 16. Typically, tens to hundreds bbl (about 1–150 $m^3$) of overflush 36 are injected in order to push the main chemical inhibitor slug from approximately 5 ft to 25 ft (about 1.5–7.6 m) away from the wellbore (FIG. 2(*d*));
5. Shut-in the well 32 for a "soak" period in order to allow the interaction between the inhibitor 30 and rock matrix to occur—typically from 4 hours to 24 hours (FIG. 2(*e*));
6. Put the well 32 back on production allowing the flows of oil (and water) to re-establish. The well 32 may not produce its full pre-treatment volumetric flow rate immediately i.e. it may require a "clean up" time (FIG. 2(*f*).

Note that even although the SIST involves several steps, for clarity and simplicity hereinafter the SIST is referred to as if it were a single treatment.

Over time, the level of inhibitor 30 in the produced water after a scale inhibitor squeeze will gradually drop below an acceptable threshold level (referred to as the MIC= Minimum Inhibitor Concentration) for the further prevention of scale formation. Below this MIC level, scale may now form almost as readily as before and another "squeeze" treatment is required. The time between such squeeze treatments defines the "squeeze lifetime". It has also been discovered that the squeeze lifetime is longer the lower the cumulative volume of water that is produced, i.e. a scale inhibitor squeeze treatment in a well producing 100 barrels (about 16 $m^3$) of water per day (bbl/D) will generally last longer in time than a similar treatment in the same well producing 1000 bbl/D (about 160 $m^3$/D) although the cumulative volume of treated produced brine may be broadly similar. Despite this latter fact, it is highly desirable to extend squeeze lifetime as long as possible.

Inventive Combined Water Control and Scale Inhibitor Squeeze Treatments

Benefits: From the above discussion, it follows that if a method can be discovered to reduce the quantity of produced brine in a given well, then such a method would have a number of generally recognised benefits per se. Specifically, one of these benefits would be that less scale would form due to the lower production of brine. As a consequence, where there is lower brine production, a scale inhibitor squeeze treatment will generally last longer, i.e. it will, other things being equal, extend the scale inhibition squeeze lifetime in actual time.

Other benefits of having a chemical treatment which combines the functions of controlling (i.e. reducing) water production while carrying out a scale inhibitor squeeze treatment become clear. Treating a producer well is an intrinsically loss-making activity since it involves stopping and shutting in a well that is producing oil—but to prevent scale formation, this is required. However, it has been discovered that for a single entry into the well, two treatments—each of which is beneficial and/or necessary—can be carried out viz. a combined water control scale inhibitor squeeze. This combined treatment has benefits per se as well as extending the effective squeeze lifetime in the well, hence reducing the number of well interventions that are required.

Mechanics of combined treatments: Since there are different ways in which water control is applied (WSOTs or RPMT) and there are also differences in the mechanism of how scale inhibitors work (SIST-Ad, SIST-Pt, SIST-Ad-Pt), the details of the combined treatments tend to be somewhat different. However, all possible combinations—that is either (WSOT or RPMT) with any of (SIST-Ad, SIST-Pt, SIST-Ad-Pt), are encompassed by this invention and are discussed in turn below. There are in fact two main variants on the combined treatment governed by the nature of the water control method i.e. by WSOT or RPMT. Hence, these two cases will be described separately.

WSOT-SIST Combined treatments: First, how a SIST is combined with a treatment to fully block a water producing zone 12 will be outlined i.e. a WSOT (please note that several such zones may exist in a single well 32). The various stages for this type of treatment are shown schematically in FIG. 3. Firstly, in FIG. 3(*a*) the nature of the type of problem where a WSOT might be applied is one where there are a single (or several separate) reservoir zone (or zones) 12 producing water and other zones producing (mainly) oil 14. Thus, the objective is to block all of the water coming from this water zone 12 (or from each of these water zones 12) and hence complete fluid shut-off in such zones 12 is required. In WSOTs, one does not want to affect the oil flow in the (mainly) oil producing layers 14 (see FIG. 3(*a*)). In the schematic treatment descriptions below, the SIST or WSOT is referred to as a single stage treatment although in practice each may involve several steps with different fluid injection in each step, as described for the SIST above.

The stages in a combined WSOT-SIST are as follows.

Stage 1 (FIG. 3(*b*)): Shut-in the producing well.

Stage 2 (FIG. 3(*c*)): First inject the SIST 40 into the producer well 32 either with or without selective placement technology (e.g. packers 18) in the well in order to place the SIST 40 in the water producing zone 12, as shown. Note that selective placement of the scale inhibitor or SIST 40 is optional in this stage.

Stage 2(a) (not shown): An optional brine overflush may be performed at this stage if it is appropriate for the specific placement of the SIST 40 (see FIG. 2(*d*)).

Stage 3 (FIG. 3(*d*)): Inject the WSOT 20 into the producer well 32 either with or without selective placement technology in the well 32 in order to place the scale inhibitor 40 in the water producing zone 12, as shown. Note that selective placement of the water control chemical 20 is strongly recommended for this stage and is of more importance in the correct placement of the WSOT 20 than for the SIST 40. In addition, the chemical slug used in the WSOT 20 may also contain a level of scale inhibitor 30 with a concentration on the order of tens to hundreds of ppm to afford additional scale protection (the combination designated as 42).

Stage 3(a) (not shown): An optional brine overflush may be performed at this stage if it is appropriate for the specific placement of the WSOT (and the previous SIST).

Stage 4 (FIG. 3(*e*)): Following a suitable "soak" period, the producer well 32 is put back on normal production. There may be some "clean up" time needed for the well and, indeed, if the WSOT has worked correctly, it should not return to the full volumetric fluid production rate at the same pressure drawdown. However, the water production rate should be lower and the fractional flow of oil should be higher. In addition, the produced water should now contain an appropriate concentration of scale inhibitor and the effective squeeze lifetime should be longer as a consequence of the reduced water production.

RPMT-SIST Combined treatments: Next will be outlined how a SIST is combined with a treatment to disproportionately change the water and oil flows in the same producing zone or zones, i.e. a RPMT (commonly several such zones may exist in a single well). The various stages for this type of treatment are shown schematically in FIG. 4. Firstly, in FIG. 4(*a*) it is noted that the nature of the type of problem where a RPMT might be applied is where there are a several reservoir zones co-producing water and oil. Thus, an objective is to reduce the water flow and to maintain the flow of oil (although some small reduction in the oil flow rate may be acceptable). For the same pressure gradient, the fractional flow of oil will be increased by a successful RPMT. In the schematic treatment descriptions below, each of the SIST or RPMT is referred to as a single stage treatment although in practice each may involve several steps with different fluid injection at each step as described for the SIST above.

The stages in a RPMT-SIST are as follows.

Stage 1 (FIG. 4(*b*)): Shut-in the producing well 32.

Stage 2 (FIG. 4(*c*)): First, inject the SIST 40 into the producer well 32 either with or without selective placement technology in the well in order to place the scale inhibitor 40 in the water producing zone 12, as shown. Note that selective placement of the scale inhibitor is optional in this stage and one would normally inject this as a "bullhead" treatment (i.e. without placement technology) as is illustrated in FIG. 4(*c*).

Stage 2(a) (not shown): An optional brine overflush may be performed at this stage if it is appropriate for the specific placement of the SIST 40 (again, please see FIG. 2(*d*)).

Stage 3 (FIG. 4(*d*)): Inject the RPMT 44 into the producer well 32 either with or without selective placement technology in the well in order to place the scale inhibitor in the water/oil producing zones, as shown. Note that selective placement of the RPMT 44 is optional in this stage and one would normally inject this as a "bullhead" treatment (i.e. without placement technology) as is illustrated in FIG. 4(*d*). In addition, the chemical slug used in the RPMT 44 may also contain a level of scale inhibitor with a concentration on the order of tens to hundreds of ppm to afford additional scale protection.

Stage 3(a) (not shown): An optional brine overflush may be performed at this stage if it is appropriate for the specific placement of the RPMT 44 (and the previous SIST) 40 (again, please see FIG. 2(*d*)).

Stage 4 (FIG. 4(*e*)): Following a suitable "soak" period, the producer well 32 is put back on normal production. There may be some "clean up" time necessary for the well and, indeed, if the RPMT 44 has worked correctly, it should not return to the full volumetric fluid production rate at the same pressure drawdown. However, the water production rate should be lower and the fractional flow of oil should be higher. In addition, the produced water should now contain an appropriate concentration of scale inhibitor and the effective squeeze lifetime should be longer as a consequence of the reduced water production.

Technical and Application Notes

A number of technical matters involving the basic science of these combined treatments along with their field application have been considered and are encompassed by this invention, including, but not necessarily limited to the following.

(1) WSOT and RPMT Materials: Many materials—usually but not exclusively of a polymeric nature—have been used for both water shut off and relative permeability modifier treatments (WSOTs and RPMTs). Examples of such polymeric materials include, but are not necessarily limited to, polyacrylamides (PAM)—sometimes in their hydrolysed form (HPAM)—as well as non-ionic and cationic forms of polyacrylamide, silica gels, resins, cements, etc. Crosslinkers used to gel the polymers include, but are not necessarily limited to, aluminum (III), chromium (III), boron, several other metal ions and also many organic materials such as glyoxal. Within the context of this description, all of these treatments and all combined treatments herein refer to all such water control materials, unless otherwise noted.

(2) SIST Materials: Many materials—usually but not exclusively phosphonates and polymeric species—have been used for scale inhibitor squeeze applications (SISTs). Examples of scale inhibitors include, but are not necessarily limited to, phosphonates such as DETPMP, polyphosphinocarboxylic acids (PPCA) and polymers such as poly acrylate (PAA), poly vinyl sulphonate (PVS), sulphonated poly acrylates (VS-Co), phosphomethylated polyamines (PMPA) etc. Within this description, references to scale inhibitor materials and/or combined treatments include all such scale control materials, unless otherwise noted.

(3) Horizontal well applications—diverters: Although the illustrative examples shown and described herein have been applied to schematics of vertical wells, the combined water control-scale inhibitor squeeze treatments may also be applied with some process design modifications in horizontal wells. In some cases, it may be desirable to use diverter fluids for the correct placement of the water control and SIST slugs and the methods of this invention are expected to be applicable for such applications.

(4) Treatment design: Software has been developed to model and hence design such well treatments.

(5) Competitive adsorption: In the case of RPMs, they are known to involve a surface adsorption mechanism in order to cause a differential change in the water and oil flows—as, indeed, may the scale inhibitor. In the combined treatment, some proportion of the rock adsorption sites may be occupied by scale inhibitor thus reduce the effect of the polymeric adsorption for the RPM. However, it is likely that the much smaller scale inhibitor molecules will be selectively displaced by the strongly adsorbing polymer although this effect may take some hours for which a shut-in will be necessary.

Sequence: In the case of a RPMT, the SIST may be injected before, after or together with the RPMT injection. In the case of the WSOT, injection of the SIST with the WSOT is not desirable, since no water will flow through the gel that is formed. Bullhead injection after the WSOT is less effective than before as the scale inhibitor in the blocked zone will not be able to protect the well against scale formation. The oil producing zones, however will be protected from water that diverts around the blocking gel.

Verification Using a Near Wellbore Scale Inhibitor Squeeze Treatment Design Simulation Model (SQUEEZE V)

The proof of concept of this invention has been carried out using predictive modeling using a software model, SQUEEZE V. The scale inhibitor squeeze treatment (SIST) is calculated for a 5 layer near wellbore field case before and after a conceptual water control treatment has been carried out. The main details and design parameters are as follows:

(a) A 5-layer near wellbore r/z-grid simulation model is constructed with layer permeabilities: $k_1$=150 mD (top), $k_2$=150 mD, $k_3$=300 mD, $k_4$=100 mD, $k_5$=100 mD (bottom).

(b) Each layer is 15 ft (4.6 m) thick and has porosity, $\phi$=0.17.

(c) The scale inhibitor treatment volume of 1059.7 bbl (168.5 $m^3$) of concentration 130,000 ppm inhibitor was pumped at a rate of 3.7103 bbl/min. (0.59 $m^3$/min.) into the formation followed by an overflush of 1816.7 bbl (288.8 $m^3$) of brine pumped at 3.9063 bbl/min. (0.62 $m^3$/min.).

(d) The scale inhibitor adsorption isotherm, $\Gamma(C)$, is described by a Freundlich function of the form, $\Gamma(C)=\alpha.C^{\beta}$ where $\alpha$=489.2 and $\beta$=0.35 (C in ppm) and non-equilibrium adsorption is assumed;

(e) The modeled water control treatment is of RPMT type and the water reduction varies from layer to layer in the model, but is in the approximate range 20–25%.

(f) A straightforward SIST of (non-equilibrium) adsorption type is modeled with a set of base case water flows from the 5 layers based on the local permeabilities of the layers. A combined RPMT-SIST is then modeled with the above assumptions of water flow reduction.

Figure 5:
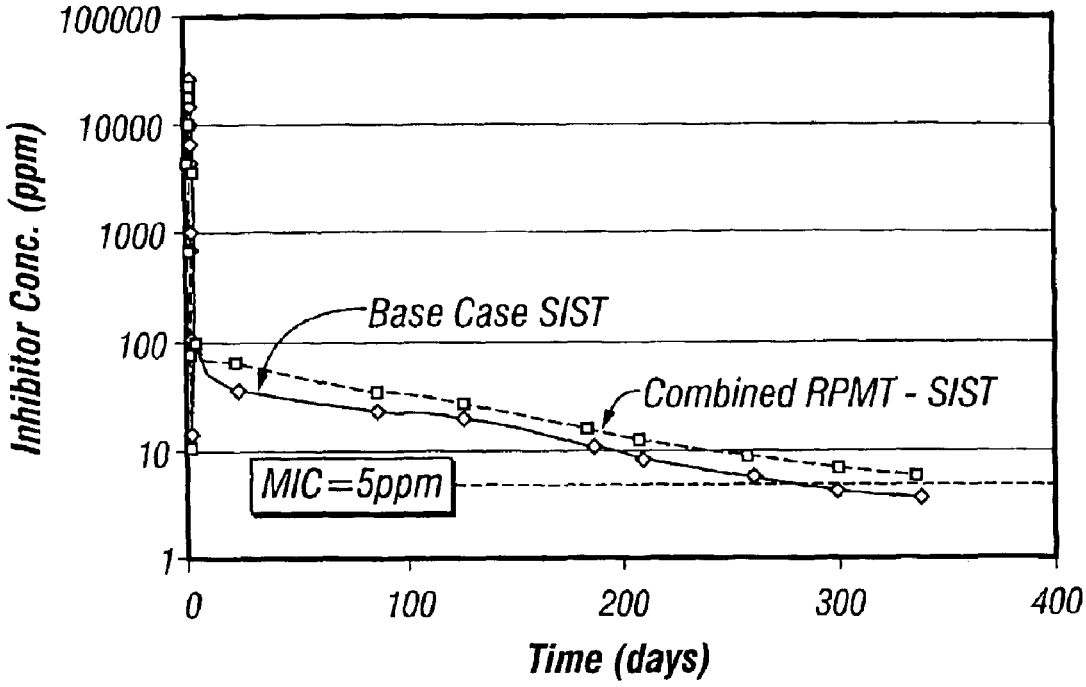
FIG. 5 is a graph of predicted scale inhibitor squeeze returns as a function of time from a model field case for a base case SIST and a combined RPMT-SIST as calculated by a near wellbore scale inhibitor squeeze treatment design simulation model (SQUEEZE V).

(g) The predicted scale inhibitor returns are shown for this case for the SIST and the combined RPMT-SIST in FIG. 5.

As shown in FIG. 5, the combined treatment shows a significant improvement in the scale inhibitor performance for the very modest levels of water control using a RPMT. At an assumed of MIC=5 ppm, an increase in squeeze lifetime of approximately 30% is predicted.

The process design and chemical materials that can be used therein are described for the inventive combined water control and scale inhibitor squeeze treatment. Two types of combined applications are explicitly identified as follows:

(i) WSOT-SIST: which is more appropriate when certain reservoir layers produce entirely water and other layers produce (mainly) oil; and (ii) RPMT-SIST: which is more appropriate when several reservoir layers co-produce both water and oil.

The concept has been verified using predictions from the simulation model, SQUEEZE V that show that a relatively modest level of water control can lead to significant improvement in the scale inhibitor returns.

It is expected that all chemical systems which have previously been identified for use in the separate treatments (water control and scale inhibitions) can likewise be used for such combined treatments.

Many modifications may be made in the methods of this invention without departing from the spirit and scope thereof that are defined only in the appended claims. For example, the exact scale inhibitors and/or polymer gels or other relative permeability modifiers may be different from those used here. Various combinations of stages or steps of the water control and/or scale inhibitor squeeze treatments other than those exemplified or explicitly described here are also expected to find use in providing an improved combined method. Further, different operating parameters from those discussed and exemplified are also expected to be useful herein.

We claim:

1. A method for inhibiting the formation of scale and the production of water in a well in a subterranean formation having at least one water production zone comprising:

shutting in the well;

injecting a water control treatment into the water production zone, where the water control treatment is selected from the group consisting of relative permeability modifier treatment (RPMT) and treatments using a material selected from the group consisting of cross-linked polysaccharides, polyacrylamides; silica gels, resins and cement, and polysaccharides and polyacrylamides in their hydrolysed, non-ionic and cationic forms, non-crosslinked polysaccharides and non-crosslinked polyacrylamides, and combinations thereof;

squeezing a scale inhibitor into the water production zone before, during or after injecting the water control treatment;

soaking in the well; and back producing the well.

2. The method of claim 1 further comprising applying an overflush into the water production zone following injecting the water control treatment.

3. The method of claim 1 where in injecting the water control treatment further comprises simultaneously injecting additional scale inhibitor.

4. The method of claim 1 where the water production zone is also a hydrocarbon production zone.

5. The method of claim 1 where the subterranean formation further comprises a hydrocarbon production zone.

6. The method of claim 1 where in squeezing the scale inhibitor into the water production zone, the scale inhibitor operates by mechanism selected from the group consisting of an adsorption mechanism, a precipitation mechanism, and a combination thereof.

7. The method of claim 1 where the water control treatment is a water shut-off treatment (WSOT) and squeezing the scale inhibitor is conducted before the WSOT.

8. A method for inhibiting the formation of scale and the production of water in a well in a subterranean formation having at least one water production zone, the method comprising:

shutting in the well;

injecting a water control treatment into the water production zone, where a material used in the water control treatment is selected from the group consisting of cross-linked polysaccharides, polyacrylamides; silica gels, resins and cement, or polysaccharides and polyacrylamides in their hydrolysed, non ionic and cationic forms, non-crosslinked polysaccharides and non-crosslinked polyacrylamides, and combinations thereof;

squeezing a scale inhibitor into the water production zone before, during or after the water control treatment, where the scale inhibitor operates by mechanism selected from the group consisting of an adsorption mechanism, a precipitation mechanism, and a combination thereof;

soaking in the well; and back producing the well.

9. The method of claim 8 further comprising applying an overflush into the water production zone following injecting the water control treatment.

10. The method of claim 8 where in injecting the water control treatment further comprises simultaneously injecting additional scale inhibitor.

11. The method of claim 8 where the water production zone is also a hydrocarbon production zone.

12. The method of claim 8 where the subterranean formation further comprises a hydrocarbon production zone.

13. The method of claim 8 where the water control treatment is a relative permeability modifier treatment (RPMT).

14. The method of claim 8 where the water control treatment is a water shut-off treatment (WSOT) and squeezing the scale inhibitor is conducted before the WSOT.

15. A method for inhibiting the formation of scale and the production of water in a well in a subterranean formation having at least one water production zone, the method comprising:

shutting in the well;

injecting a pre-flush or spearhead fluid into the water production zone, then squeezing a scale inhibitor into the water production zone, where the scale inhibitor operates by mechanism selected from the group consisting of an adsorption mechanism, a precipitation mechanism, and a combination thereof;

performing a water control treatment stage selected from the group consisting of a water shut-off treatment (WSOT) and a relative permeability modifier treatment (RPMT), and where the water control treatment stage further comprises injecting a the water control treatment into the water production zone following the scale inhibitor, where a material used in the water control treatment is selected from the group consisting of cross-linked polysaccharides, polyacrylamides; silica gels, resins and cement, and polysaccharides and polyacrylamides in their hydrolysed, non ionic and cationic forms, non-crosslinked polysaccharides and non-crosslinked polyacrylamides, and combinations thereof;

soaking in the well; and back producing the well.

16. The method of claim 15 further comprising applying an overflush into the water production zone following injecting the water control treatment.

17. The method of claim 15 where in injecting the water control treatment further comprises simultaneously injecting additional scale inhibitor.

18. The method of claim 15 where the water production zone is also a hydrocarbon production zone.

19. The method of claim 15 where the subterranean formation further comprises a hydrocarbon production zone.

* * * * *